United States Patent [19]

Singer

[11] 4,224,356

[45] Sep. 23, 1980

[54] DEPOSITION OF METALS ON A BASE

[75] Inventor: Alfred R. E. Singer, Swansea, Wales

[73] Assignee: The Secretary for Defence in Her Britannic Majesty's Government of the United Kingdom of Great Britain and Northern Ireland, London, England

[21] Appl. No.: 910,538

[22] Filed: May 30, 1978

[30] Foreign Application Priority Data

May 31, 1977 [GB] United Kingdom ..... 22914/77
Nov. 26, 1977 [GB] United Kingdom ..... 49306/77

[51] Int. Cl.[2] ..... B05D 3/06

[52] U.S. Cl. ..... 427/34; 427/422; 427/423; 427/367

[58] Field of Search ..... 427/34, 423, 355, 369, 427/370, 422, 367; 118/100, 76

[56] References Cited

U.S. PATENT DOCUMENTS

| | | | |
|---|---|---|---|
| 1,654,509 | 12/1927 | Claus | 427/422 |
| 2,640,002 | 5/1953 | Clayton | 427/369 |
| 2,699,403 | 1/1955 | Courts | 427/355 |
| 2,723,204 | 11/1955 | Pottbers et al. | 427/196 |
| 3,066,042 | 11/1962 | Ogden | 427/422 |
| 3,340,084 | 9/1967 | Eisenlohr | 427/423 |

FOREIGN PATENT DOCUMENTS

| | | | |
|---|---|---|---|
| 230904 | 11/1959 | Australia | 118/100 |

*Primary Examiner*—John H. Newsome
*Attorney, Agent, or Firm*—Stevens, Davis, Miller & Mosher

[57] ABSTRACT

A process for forming metallic articles involves generating a stream of atomized molten metal particles, directing this stream of particles at a substrate to form a deposit of the metal thereon having a desired form, and simultaneously directing at the metal as it is deposited on the substrate, a stream of rounded particles so as to consolidate the deposited metal. Apparatus for forming metallic articles includes means for generating a stream of atomized molten metal particles and means for producing a stream of rounded particles both of said means being so arranged as to cause the streams to converge on an area, and means for maintaining a substrate arranged to coincide with the area and adapted to receive thereon a deposit of the metal. The substrate may be incorporated into the metallic article product e.g. when it is a worn or damaged component which is being repaired or when it is an object such as a turbine blade being coated, or the substrate may just be a carrier for a metallic article entirely formed of the sprayed metal. The simultaneous spraying and hot working produces articles with excellent mechanical and physical properties and by appropriate choice of conditions very good adherence to or ready releasability from the substance can be ensured, as desired.

19 Claims, 4 Drawing Figures

DEPOSITION OF METALS ON A BASE

The present invention relates to a process for the production or repair of metallic articles.

Articles of metal are commonly made by casting the molten metal into a shape which approximates that of the required article and then by machining the cast article to the final desired shape. The amount of machining which is required is related to the complexity of the article and may be considerable, even to the extent that more metal may need to be removed from the cast body that remains in the finished article. Machining of metal parts is a very expensive process involving use of complex machinery, skilled labour and input of considerable energy, and alternative methods of forming complex shaped articles having good mechanical properties have been sought. Several methods have been devised in which a metal is deposited by spraying onto a substrate to form an article of more complex shape, but the mechanical properties of such deposited layers of material have been in general much poorer than those of the corresponding wrought material. Similar methods can be used to restore damaged or worn metal articles but in this case there is an additional problem in that it is difficult to achieve a good bond between the original article and the new material which is deposited to effect the repair.

The mechanical properties of a deposited metal can be improved by subjecting it to peening after deposition. This involves bombarding the metal surface with relatively hard shot and effects a cold working of the metal in the surface region thereof. However the effect of such peening is restricted to an essentially superficial region of the article being treated, and so the properties of regions of the article deeper down will not be affected by the peening. A further disadvantage of subsequent peening is that it may destroy the adherence of the deposited metal to a substrate as a result of the internal compressive stresses which are generated by the cold working action of the subsequent peening.

I have now found that by simultaneously spray depositing metal onto a substrate whilst at the same time bombarding the deposit with hard, rounded particles, the deposit is hot plastically deformed as it is being built up with consequent development of greatly enhanced physical and mechanical properties. Surprisingly I have found that the two operations do not interfere with each other but instead co-operate to produce products which have metallurgical properties markedly better than those obtained with spray deposited articles produced heretofore.

Accordingly the present invention provides a process for forming metallic articles which comprises generating a stream of atomized molten metal particles; directing said stream of atomized molten metal particles at a substrate to form a deposit of said metal thereon having a desired form, and simultaneously directing at said metal as it is deposited on said substrate, a stream of rounded particles so as to consolidate the deposited metal.

The invention further provides apparatus for forming metallic articles which comprises means for generating a stream of atomized molten metal particles and means for producing a stream of rounded particles both of said means being so arranged as cause said streams to converge on an area, and means for maintaining a substrate arranged to coincide with said area and adapted to receive thereon a deposit of said metal.

The present invention thus provides a method and apparatus for the spray deposition of a metal and for the concurrent hot working of the deposited metal. The atomized molten metal particles impact upon the substrate and one another to produce splat particles in the form of "pancakes" which adhere to one another, and if desired could often be made to adhere to the substrate also. As a result of the simultaneous deposition and hot plastic deformation, the physical and mechanical properties of the deposited metal are markedly improved compared to those of conventional spray deposits. In particular the hot working brings many metallurgical benefits such as recrystallization, a fine grain size and high density of the deposit. Furthermore as a result of hot working of the deposit most of the kinetic energy of the peening particles is absorbed by the deposit and hence the velocity of rebound of these particles is relatively low. This not only makes the design of apparatus for carrying out the process simpler and reduces wear of the apparatus but also leads to a more efficient utilization of the energy which is imparted to the peening particles. At the same time, as the latter are cold relative to the sprayed-on metal particles they can assist in cooling down the deposit as it forms depending upon their temperature and kinetic energy, and this allows thick deposits to be built up more rapidly than is conventionally possible. A further considerable advantage of the process of the invention is that, unlike the conventional spray deposition process, it does not result in residual tensile stresses within the last deposited layers of the metal, which tend to cause cracking of the deposit or distortion of the substrate. The concurrent hot working overcomes this problem, and, indeed, if desired, it is possible thereby to produce compressive stresses instead.

It may be appreciated therefore that by use of the process of the invention, very good control of the progressive build-up and quality of a spray-deposited metal is achieved.

The process is preferably carried out in an inert atmosphere in order to avoid reaction of the atmosphere with the atomized liquid metal particles. An atmosphere of nitrogen is most conveniently used. In order to maintain the inert gas atmosphere the process is most conveniently carried out in a chamber which entirely encloses the area of deposition. Alternatively the area of deposition may be screened from the atmosphere by use of jets of inert gas surrounding the area, or by a shroud which covers the area.

The metal deposited according to the process of this invention may be intended to build up an already existing metal article, e.g. to add detailed features to a simple basic shape, or it may be intended to restore a worn or damaged metal article to its original form. As a further possibility the deposit may itself comprise the finished article and the substrate on which it is formed may merely be a carrier from which the deposit is subsequently removed. The substrate will generaly be of metal.

The substrate may be of any shape or form and may be fixed or movable. For example the substrate may be an article on which a metal layer is deposited or which is built up to a complex shape by deposition of repeated layers of material, or it may be in the form of a continuous belt or long strip which moves relative to the spraying source, thus building up a layer of deposited and hot worked metal continuously or semi-continuously. The latter form of substrate will be particularly appropriate where the article is to be formed entirely from the spray-deposited metal i.e. where the substrate is merely a carrier on which the article is built up. On the other hand, spray-depositing on individual workpieces will often be more appropriate to the development of outlines of complex shape on parts of equipment or to the repair of worn or damaged items of equipment. Another important use of the invention is in providing coatings for such items as turbine blades in which good mechanical properties and excellent adherence to the base member are of especial importance. In all these cases further machining of the parts after spray deposition/peening may be necessary in order to provide final tolerances, but this can be kept to a minimum by the appropriate choice of the spray pattern in the apparatus of the invention, and/or by establishing an appropriate motion of the substrate.

When the substrate is designed to move relative to the source of the sprayed metal and the peening particles, the movement may be linear or rotational or any combination thereof. In many cases it is convenient for the spraying/peening apparatus to be a movable assembly end for the area of the substrate on which deposition/peening is to occur to be surrounded by a shroud which can be filled with an inert gas.

Where the article formed by the process is built up from a preformed member, it will be apparent that the structure of the deposit will generally be different from that of the metal substrate because its thermal and mechanical history is different. However the built-up article can be heat treated or given any other subsequent treatment in just the same way as with conventional materials. Although metals and alloys of any composition may be deposited on the substrate, so that the deposit and the substrate may have different properties, it is found that with complex built-up articles it is preferable for the deposited metal to be of somewhat similar composition to the base as this minimises internal stresses during service. However where the use demands that two regions of an article should be of entirely different composition, the present process can, with particular advantage, be employed to make such an article, since the extremely rapid rate of freezing of each metal particle as it deposits on the substrate prevents the formation of undesirable intermetallics at the interface between the two regions. Furthermore the process is particularly valuable when a graduation of composition is required in the deposit. In such cases the composition of the metal feed to the atomizer may be gradually changed leading to a similar gradual change in composition of the deposit as it builds up.

In the case of built up articles, i.e. where the deposited metal forms a part of a larger article, good adherence of the deposit to the metal substrate is necessary. The simultaneous peening action of the process of the invention has the effect of breaking up residual oxide films on the surface of the substrate provided these are not too thick, and as a result of this, very satisfactory adherence of the metal deposit to the substrate is generally achieved. Even better adherence may be obtained by heating the substrate and by cleaning the substrate so that it is free from oxide and other contaminants. Conventional cleaning methods may be employed to achieve a clean substrate, such as grit blasting, scratch brushing and pickling, washing and draying. Where no substantial quantities of $A1_2O_3$, $Cr_2O_3$ or Ti $O_2$ are present, a particularly effective cleaning method involves heating the substrate metal surface in air to give a light oxidizing treatment, and then reducing in hydrogen or other reducing gas. It is also advantageous to slightly roughen the surface of the metal base by, for example, machining, grinding, grit blasting or scratch brushing it. In this case the metallurgical bonding is enhanced by a mechanical keying effect. It will be appreciated that it is necessary to maintain the clean surface which has been prepared at least until a first layer of metal particles has been deposited on the surface and this can be achieved by surrounding the surface with an inert or reducing atmosphere up to and during the process of deposition. Nitrogen or an inert gas may conveniently be used for this purpose.

In the case of built up articles it is often advantageous to initially deposit one or two layers of atomized metal particles before peening commences. In some cases it is also advantageous to continue peening for a short while after the completion of the deposition process.

Where, on the other hand, it is desired to remove the metal deposit from the substrate after deposition, it may be necessary to adopt special measures to ensure that this is possible. Such measures are well know in the art. Thus a substrate which is heavily contaminated with oxide, which forms a tenacious oxide film or which is of an entirely different composition (e.g. use of case iron when aluminum is being deposited) can be used to give the required separation, or a parting agent or compound such as is used on moulds for casting metals may be employed. A further method is to keep the substrate cold or to peen it before spraying commences in order to make it very smooth.

For the best results, with both the metal spray deposition and peening processes, it is necessary that the particles should travel along a path normal to the substrate surface. In practice of course it is not possible to satisfy both conditions simultaneously and a compromise has to be reached. On balance normal peening and slightly angled spraying is preferred although the reverse is quite possible and has the advantage of greater ease of removal of the re-bounding peening particles.

The atomized molten metal particles used in the process of the invention may be generated in various ways e.g. from a solid metal wire or powder using conventional metal spraying equipment or for metal powder using a plasma spray technique, or from a stream of liquid metal using gas jets blown through it or a rotating impellar to atomize it. The atomized particles conveniently have a size of from 20 to 200 microns.

The solid (peening) particles must have a rounded form as otherwise they will tend to become embedded in the deposited metal or to remove the deposited metal. The particles should also be hard enough to be effective as agents of hot working the deposited metal. They should also be durable enough so that they will not fracture and form angular framents when in use since this could lead to entrapment by and/or damage to the deposited surface material. Steel balls are preferred as the peening particles through glass balls can also be used. The peening particles preferably have a minimum particle size of 0.5 mm and also are preferably larger than the atomized liquid metal particles by a factor of at least 5 in their respective diameters. When the peening particles are too small they will have an inadequate momentum and will be incorporated in the deposited layers. On the other hand the larger the particles the more inconvenient they are to handle and project in large quantities and also the lower is the peening efficiency and coverage of the particles. A generally convenient range of size for the peening particles is 0.5 to 10 mm, with particles in the upper part of the range preferred for high deposition rates and the smaller particles for low deposition rates. Deposition rates apart though it is preferred to use particles of the smallest size practicable since these are more efficient (per unit weight) than larger particles at extracting heat from the deposit and also produce better hot-working (per unit weight of particles) of the deposited metal than do larger particles.

The peening particles are projected at the deposited metal at a velocity of 5 to 100 m/sec. Speeds are preferably at the lower end of this range in order to achieve a cooling effect on bombardment, unless it is instead desired to heat up the substrate in which case higher speeds should be used. The break even point in respect of heating or cooling the substrate is dependent on the temperature of the deposit, on the velocity of the peening particles as described and on the size of the particles; the smaller the particles the higher is the velocity possible before cooling of the substrate gives way to heating. Higher velocities are also possible without losing the cooling effect the higher the temperature of the deposit.

The particles may be projected by either mechanical or electrical (electromagnetic) means. Pneumatic means of accelerating the particles are generally unsuitable because of disturbance of the pattern of the spray of atomized particles by the carrier gas. Methods of accelerating peening particles or balls are well known in the art and will not be described here. The weight of peening particles used will be generally in the range of 5 to 20 times the weight of the deposited metal.

The peening particles do not require to be pre-heated and indeed they act more effectively if they are at normal temperature. Then, because they are cold, smooth and relatively small they will not accumulate a great amount of the sprayed metal onto their surfaces, though they will normally become coated with a very thin layer of the metal which is being sprayed. The particles can be reused without difficulty because they must normally be subjected to a process of screening on exit from the spray area in order to separate the particles from the excess sprayed metal which accumulates in the chamber as a powder and any coating which has formed on the particles will normally become detached during this screening process. The surplus spray particles and detached coatings can be remelted and reused whilst the peening particles are returned to the container via a gas trap.

The peening particles should preferably be kept in a container or hopper sealed from the air and this is preferably supplied with a small purging supply of inert gas. During operation in the case where the peening particles are projected mechanically the container may be under slightly reduced pressure as a result of the rotation of the impeller tending to pump gas from the hopper into the chamber with the particles. The chamber also is preferably filled with inert gas to avoid oxidation of the spray metal particles. After bombarding the metal deposit on the substrate the peening particles bounce off it and can easily be collected for reuse.

The invention will now be further described by reference to some examples of the application of the process of the invention and in particular to the accompanying drawings and to the drawings accompanying the provisional specifications of Applications Nos. 22914/77 and 49306/77. In the drawings, FIG. 1 is a side elevation, partly sectioned along the line I—I of FIG. 2, of apparatus according to the invention of the deposition of aluminium alloy strip on a continuous moving substrate;

Figure 1:
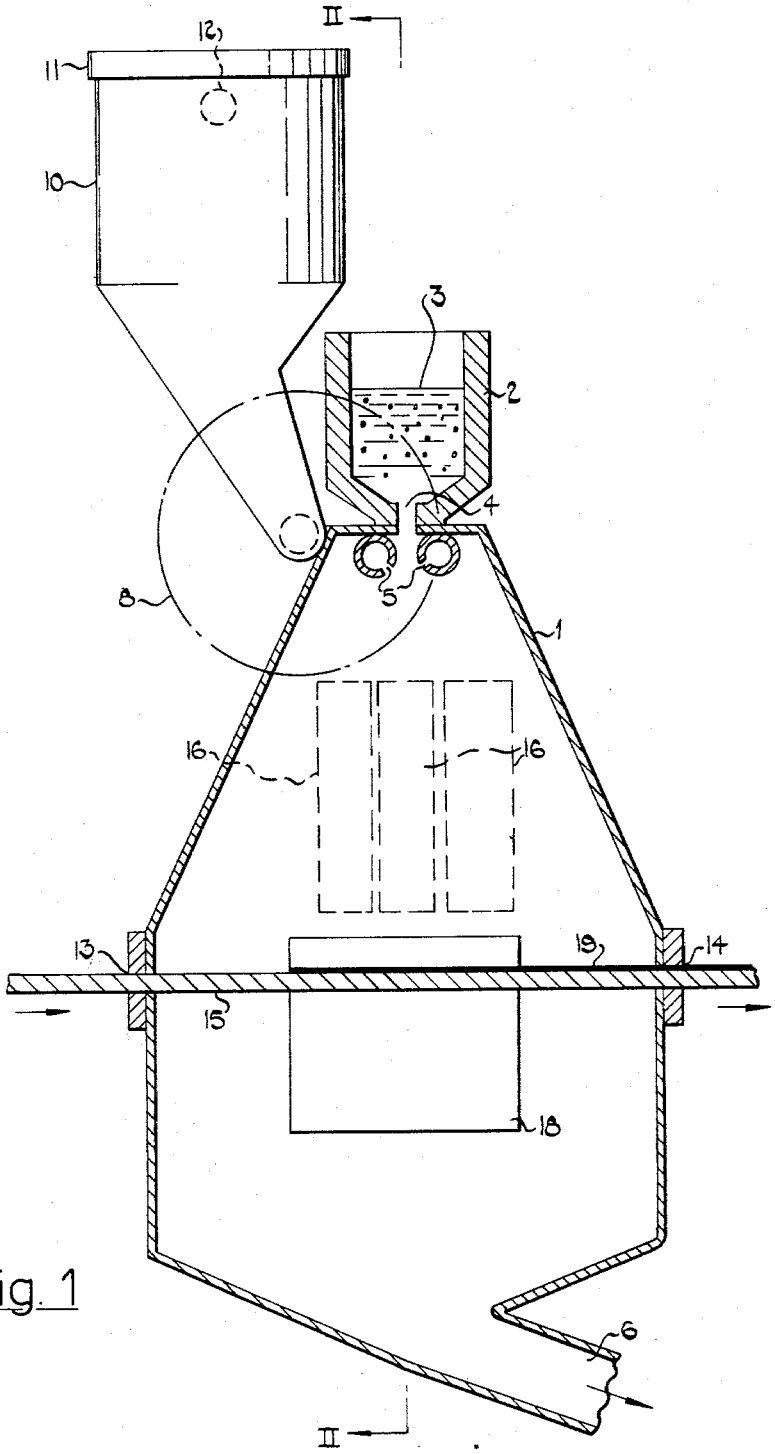
Figure 2:
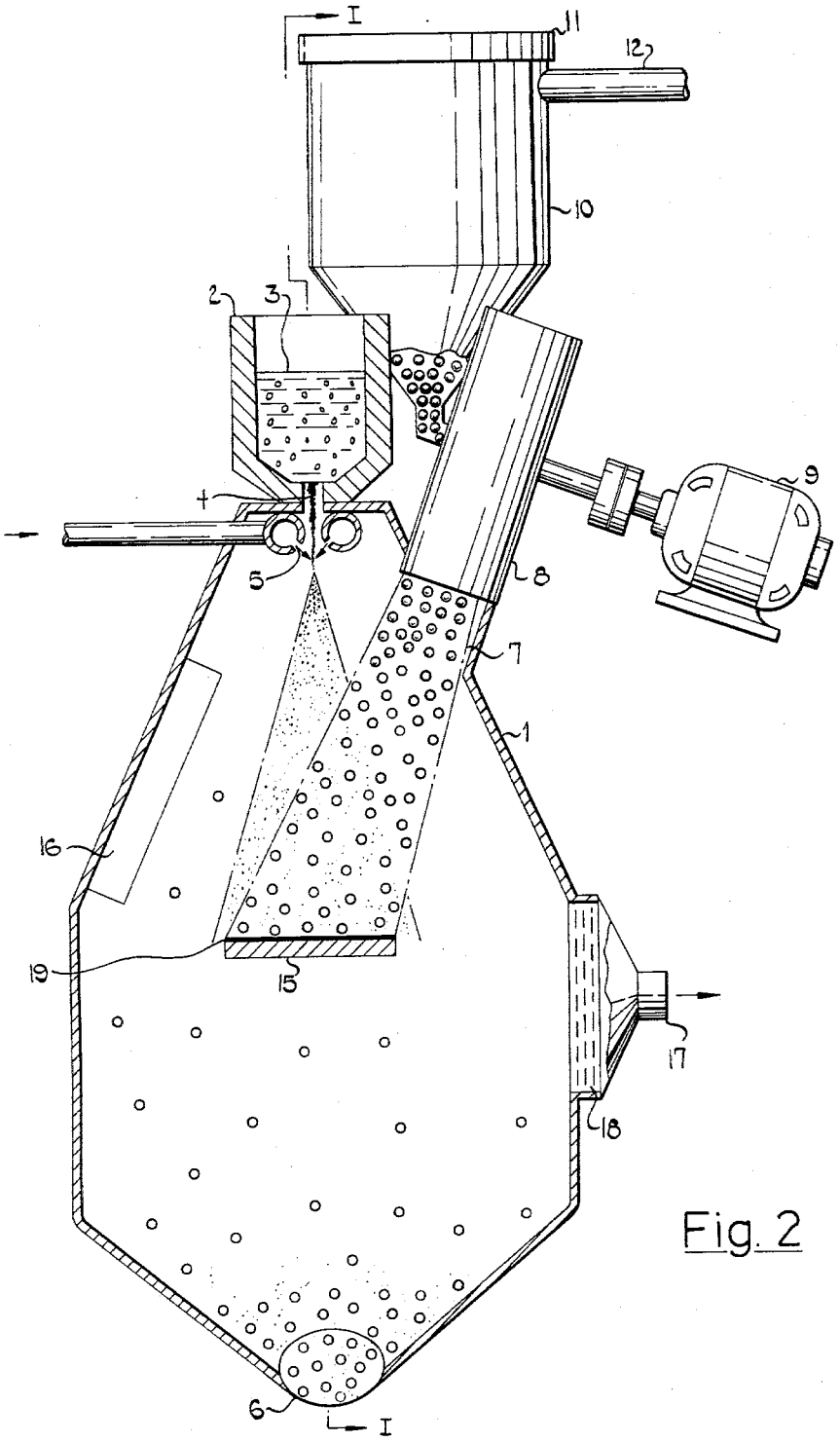
FIG. 2 is a section through the apparatus of FIG. 1 along the line II—II.

The apparatus shown in FIGS. 1 and 2 comprises a chamber 1 attached to the top of which is a tundish 2 to hold a molten metal 3 (in this case aluminium). The metal can enter the chamber via an aperture 4 surrounding which is a gas atomizer 5. The chamber 1 has an exit pipe 6, for the removal of peening particles and excess metal spray.

Let into an upper wall of chamber 1 is an opening 7 (FIG. 2) which accommodates the nozzle of a centrifugal shot slinger 8. The construction of centrifugal shot slingers is well known in the shot blasting art and need not be described further here. The slinger is driven by a motor 9 and is kept fed with shot from a hopper 10. The hopper is sealed with a lid 11 and is purged with nitrogen gas through a line 12.

The chamber also has entry and exit points 13, 14 for a stainless steel strip substrate 15 which is drawn continuously through the chamber by any suitable means (not shown). The upper walls of the chamber are provided with deflectors as at 16 which will deflect the shot rebounding from the workpiece away from the spray and molten metal inlet. The chamber is also provided with a gas exit 17 protected by a filter 18.

In operation the gas supply (nitrogen) to the atomizer is started up and molten aluminium alloy is poured into the tundish 2. The stream of molten alloy issuing through aperture 4 is atomized by high pressure nitrogen jets from the atomizer ring 5 and the spray of atomized molten metal particles produced is directed on to the stainless steel substrate 15. The substrate is simultaneously moved across the chamber at a predetermined speed. A deposit of aluminium alloy 19 is thereby produced on the substrate. At the same time the motor 9 is started and shot from the slinger is thus also directed onto the steel substrate. The spray and peening target areas are so arranged that the pattern of the spray at the leading edge precedes slightly the pattern of the shot while at the trailing edge the shot lags behind the spray. In this way although the great majority of the sprayed particles are peened as soon as they are deposited, at the leading edge a very thin layer of spray deposit is established before peening occurs and at the trailing edge there is some slight peening of the deposit after the spray has stopped.

In the process described the stainless steel substrate is not preheated or specially cleaned and so has a persistent thin surface layer of chromium oxide which effectively prevents bonding of the aluminium to the stainless steel. Thus on issuing from the chamber the hot worked fully dense aluminium alloy strip can be readily detached from the substrate.

Figure 3:
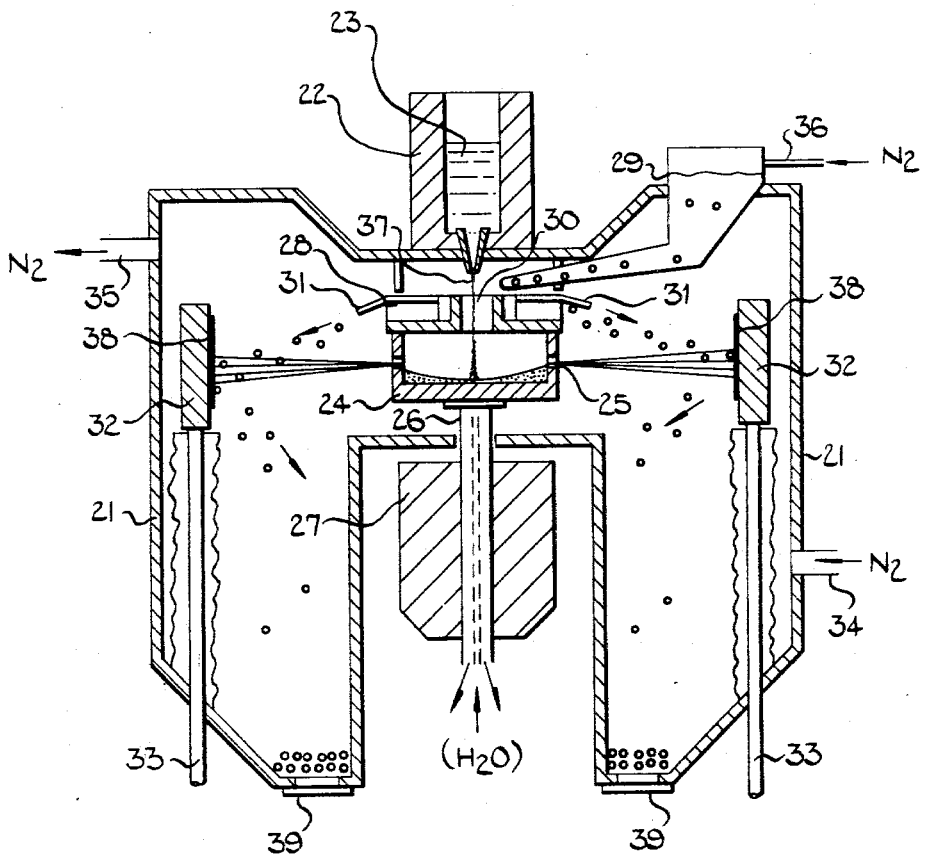
FIG. 3 is a partly sectioned elevation of an apparatus according to the invention for the production of an annular article by centrifugal deposition and peening.

FIG. 3 shows an apparatus which is suitable for producing an annular component and will be described in terms of the production of a short aluminium alloy tube. The apparatus comprises a spray chamber 21 on top of which is a tundish 22 containing a supply of molten metal 23. Towards the top of the chamber is a steel pot 24 the inside surface of which is lined with a layer of a refractory material and which has perforations 25 in its sides. The pot is supported by a vertical water cooled shaft 26 which passes through the base of chamber 21. Outside the chamber is a motor 27 which drives shaft 26. The pot is 254 mm in diameter and can be driven at 4000 rpm by the motor. On top of the pot and attached coaxially thereto is a centrifugal shot slinger 28 which is supplied with sperical hard steel balls 3 mm in diameter from a hopper 29. The slinger has a central aperture 30 through which molten metal from the tundish may fall into pot 24. The top of the slinger is provided with a peripheral deflector 31 to deflect the balls downwards slightly so that their target area coincides with that of the metal alloy spray.

In the target area is an annular substrate comprising a circumferentially split cast iron ring 32, 500 mm in diameter, supported on manipulating arms 33 by which the vertical position of the ring can be varied as desired. The chamber is nitrogen-filled with a gas inlet 34 and outlet 35, and the ball hopper is likewise nitrogen filled through inlet 36.

In operation the chamber is filled with nitrogen, the hopper 29 is filled with hard steel balls, molten aluminium alloy is poured into the tundish 22, and the motor 27 is started. A stream of metal 37 pours out through the aperture 30 in the slinger into the rotating pot 24 from whence it is thrown out through the apertures 25 and deposited on the inner surface of the ring 32. At the same time the slinger produces a stream of balls which peen the metal as it is deposited. An appropriate reciprocating movement in a vertical sense is given to the ring 32 by means of the arms 33 so that a uniform layer of alloy in the form of a tube 38 is built up on the inner surface of the ring. Spent shot and excess sprayed metal fall to the bottom of the chamber and can be removed therefrom through ports 39. By screening, the balls can be separated from the excess sprayed material and returned to the hopper 29 for reuse.

Typically the spray deposit is built up at a rate of 2 Kg per minute whilst the steel balls are fed into and issue from the slinger at a rate of about 20 Kg/min. At the conclusion of the deposition and peening process the tubular product is removed by splitting the cast iron mould. It will generally be found that the aluminium alloy tube is easily removed from the cast iron mould but if any tendency towards adhesion occurs this can readily be cured by coating the cast iron mould with a thin wash of alumina or other parting compound before deposition commences.

Figure 4:
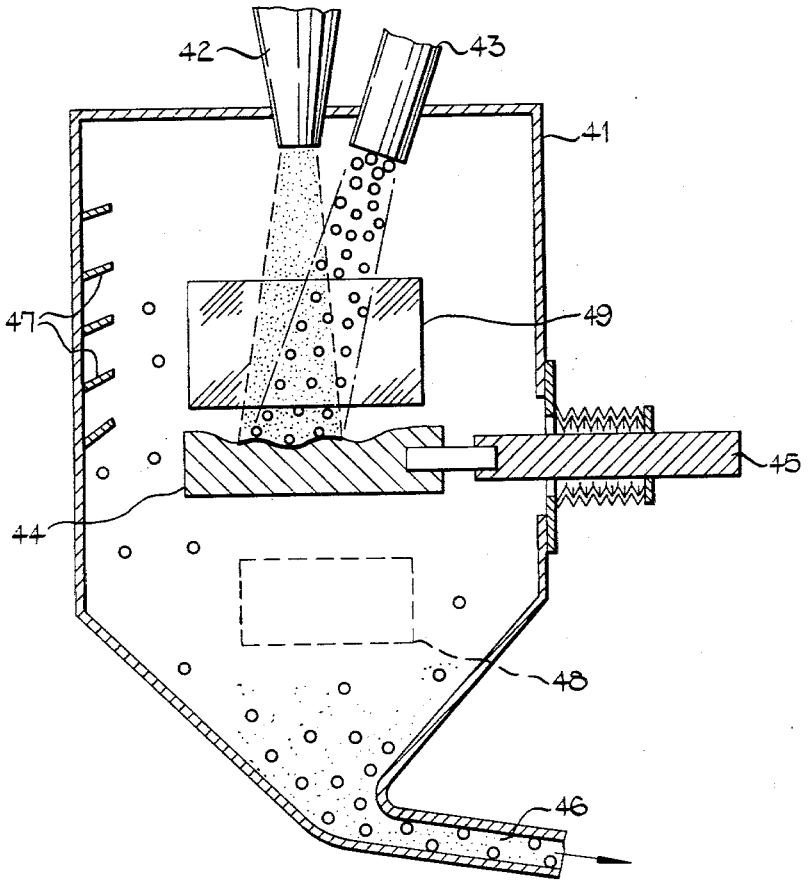
FIG. 4 is an elevation, partly in section, of apparatus according to the invention for the repair of an eroded component.

In FIG. 4 apparatus is shown which is suitable for the repair of a worn component such as a turbine blade. In this apparatus the metal spray is generated by a plasma torch fed with metal powder of the same chemical composition as that of the component. The apparatus consists of a sheet steel spray chamber 41 with a plasma torch 42 arranged to project the molten metal particles vertically downwards. A centrifugal shot slinger of which only the nozzle 43 is shown is arranged to project a pattern of spherical shot such that in the plane of the component 44 the pattern of the spherical shot lies just within the pattern of the metal spray. The component may be moved by means of a manipulator 45 and used shot and excess spray metal are removed from the bottom of the equipment via an exit port 46. Deflectors 47 prevent the rebounding shot from interfering with the deposit or the plasma gun. Used gases are extracted from the chamber through an exit 48 protected by a filter (not shown). The chamber is also provided with a window 49 through which progress on the metal deposit can be observed.

As shown in the drawing the component has a shallow worn hollow which is to be filled. In carrying out this procedure the component is first grit blasted and then introduced into the spray chamber and there heated to about 900° C. by means of the plasma torch 42. The plasma torch 42 is then fed with metal powder of the same chemical composition as the component and is arranged to project the molten particles vertically downwards on to the component. The nozzle of the shot slinger is arranged to project a pattern of shot such that in the plane of the component the pattern of the shot is just within the pattern of the metal spray. The component is moved by means of the manipulator until the worn depression is completely filled by the metal from the plasma torch. The component is then withdrawn from the chamber and after cooling any excess deposit is ground off to give the required contour to the component. Because the infilling deposit is hot worked, free from internal tensile stress and is strongly adherent to the base the properties of the required component will be equal to those of the original.

In a further example of the process of the invention, a complex shaped flange was provided on one end of a stainless steel tube in the following manner.

The tube had an internal diameter of 254 mm, an external diameter of 279 mm and a length of 686 mm, and consisted of 18/8 stainless steel. The tube was mounted in a lathe and rotated at 80 rpm. The last 75 mm of the tube was grit blasted using standard equipment in air to produce a very slightly roughened but clean surface. The grit blasted surface was found to be covered with a very thin protective film of chromium oxide which always forms automatically on exposure of a freshly cleaned stainless steel surface to air. A cylindrical protective shield was advanced over the tube and through the shield was passed a steam of high purity nitrogen displacing all the air surrounding the tube within the shield. A conventional high frequency heating coil was advanced over the cleaned end of the tube within the protective atmosphere. The end of the tube was heated to a temperature of about 800° C. in approximately 2 mins using a 150 KVA generator. The coil was withdrawn and a stream of gas atomized molten particles of 18/8 stainless steel was directed vertically downwards at the cleaned area. Simultaneously a stream of hardened steel balls (4 mm diameter) was directed at the area where deposition was taking place. The average velocity of the balls before impact was 25 m/sec. and their angle of incidence was 15° to the vertical. The balls were accelerated in a nitrogen-filled centrifugal slinger the nozzle of which was situated 127 mm from the deposit.

The stream of gas atomized molten particles of stainless steel was produced in the following manner. Stainless steel was placed in a crucible (8 Kg charge) and melted in an induction furnace. The molten stainless steel was then poured using the well known bottom pouring technique and the stream of liquid metal emerging from the bottom of the crucible was allowed to fall vertically into the confluence of atomizing jets of high purity nitrogen directed at a pressure of 120 p.s.i. The distance between the bottom of the crucible and the metal base was 203 mm.

After bombarding the deposit the steel balls bounced off the consolidated deposit on the metal base at a variety of angles. They were prevented from damaging the atomizing nozzle because they were deflected by the high pressure gases emerging from the nozzle. The balls quickly became coated with a thin film of stainless steel powder but this in no way influenced their effectiveness. They were collected and returned to the centrifugal shot slinger via a nitrogen trap.

Deposition was completed in 2 minutes after which the component was allowed to cool and subsequently machined to the finished dimensions.

What is claimed is:

1. A process for forming metallic articles which comprises generating a stream of atomized molten metal particles; directing said stream of atomized molten metal particles against a substrate to form a deposit of said metal thereon having a desired form; and simultaneously directing against said metal as it is deposited on said substrate, a stream of rounded solid particles so as to effect simultaneous peening of the deposited metal under conditions whereby the rounded solid particles are reflected from the deposited metal.

2. A process according to claim 1, which is carried out in an inert atmosphere.

3. A process according to claim 1, wherein the substrate is a metal substrate.

4. A process according to claim 3, wherein the article which is formed incorporates the substrate.

5. A process according to claim 4, wherein the substrate is a worn or damaged component and the article which is formed is a repaired component.

6. A process according to claim 3, wherein the surface of the substrate is at least substantially free of oxide films.

7. A process according to claim 1, wherein the surface of the substrate is non-adherent towards the deposited metal.

8. A process according to claim 7, wherein said surface has a tenacious or thick oxide film or is coated with a mould parting agent.

9. A process according to claim 1, wherein the substrate is in the form of a strip and continuously moved past said streams of atomized molten metal particles and of rounded particles, in order to form a metallic article in strip form.

10. A process according to claim 1, wherein the substrate is in the form of a discrete element and the metallic article product is in the form of a discrete component.

11. A process according to claim 10, wherein the metallic article product is a coated turbine blade.

12. A process according to claim 1 wherein the atomized molten metal particles have a size of from 20 to 200 microns.

13. A process according to claim 1, wherein the rounded particles have a particle size of from 0.5 to 10 mm and are larger than said atomized molten metal particles by a factor of at least 5 in their respective particle sizes.

14. A process according to claim 13, wherein the rounded particles have a particle size of about 1 mm.

15. A process according to claim 1, wherein the rounded particles are hardened steel balls.

16. A process according to claim 1, wherein the rounded particles are projected at the metal deposit at a velocity of from 5 to 100 m/sec.

17. A process according to claim 1, wherein the rounded particles are projected by mechanical or by electro-magnetic means.

18. A process for forming metallic articles which comprises atomizing molten metal to form a stream of molten metal globules, intercepting said globules on a substrate to form a deposit of molten metal on the substrate, and substantially simultaneously with said atomizing directing a stream of rounded metal particles against said deposit while it is still hot to mechanically work the metal in the deposit.

19. A process according to claim 1 in which the stream of rounded particles is directed at said deposited metal at an angle which is substantially normal to the surface of said deposited metal.

* * * * *